US009248964B2

(12) United States Patent
Banik

(10) Patent No.: US 9,248,964 B2
(45) Date of Patent: Feb. 2, 2016

(54) REFUSE CONTAINER WITH LOCKING LID

(71) Applicant: ORBIS Corporation, Ococomowoc, WI (US)

(72) Inventor: Joachim Banik, Oconomowoc, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 14/536,965

(22) Filed: Nov. 10, 2014

(65) Prior Publication Data

US 2015/0151910 A1 Jun. 4, 2015

Related U.S. Application Data

(62) Division of application No. 13/945,429, filed on Jul. 18, 2013, now Pat. No. 8,881,930.

(60) Provisional application No. 61/675,587, filed on Jul. 25, 2012.

(51) Int. Cl.
*B65F 1/16* (2006.01)
*B65F 1/02* (2006.01)
(Continued)

(52) U.S. Cl.
CPC ..... *B65F 1/1615* (2013.01); *B65F 1/02* (2013.01); *B65F 1/1468* (2013.01); *B65F 1/16* (2013.01); *B65D 25/2888* (2013.01);
(Continued)

(58) Field of Classification Search
CPC ..... B65F 1/1646; B65F 1/163; B65F 1/1623; B65F 1/16; B65F 1/1615; B65F 1/02; B65F 1/1468; B65F 1/1473; B65D 45/22; B65D 45/20; B65D 45/16; B65D 25/2894; B65D 25/2888; B65D 25/2882; B65D 25/282; B65D 25/2829; B65D 25/2832; B65D 25/28
USPC ..... 220/264, 263, 262, 326, 324, 315, 827, 220/810, 495.06, 495.01, 908.1, 908, 762, 220/763, 770, 212.5
See application file for complete search history.

(56) References Cited

U.S. PATENT DOCUMENTS 1,434,314 A * 10/1922 Raich ..... 220/757
3,825,150 A 7/1974 Taylor
4,182,530 A 1/1980 Hodge
(Continued)

FOREIGN PATENT DOCUMENTS

CA ID99947 7/2003
CA 2372465 A1 8/2003
(Continued)

*Primary Examiner* — Robert J Hicks
(74) *Attorney, Agent, or Firm* — Nixon Peabody LLP

(57) ABSTRACT

A refuse container has a container assembly. The container assembly has a bin defining a cavity, a lid, a telescopingly extensible handle assembly, a locking mechanism, a pair of wheels, and a pair of bottom handles. The lid is rotatably coupled to the bin at a pivot point, has a generally horizontal lid axis of rotation, and is movable relative to the bin between an open position providing access to the cavity and a closed position inhibiting access to the cavity. The extensible handle assembly is located adjacent the pivot point and is movable from a lower retracted position to an upper extended position above an upper surface of the lid. The locking mechanism maintains the lid in the closed position and is located opposite the extensible handle assembly. The wheels are located at the bottom of the refuse container. The bottom handles are located on opposing sides of the bin.

17 Claims, 10 Drawing Sheets

(51) Int. Cl.
*B65F 1/14* (2006.01)
*B65D 25/28* (2006.01)

(52) U.S. Cl.
CPC ..... *B65D 25/2894* (2013.01); *B65F 1/1473* (2013.01); *B65F 2220/12* (2013.01); *B65F 2250/1143* (2013.01)

(56) References Cited

U.S. PATENT DOCUMENTS

| | | | | |
|---|---|---|---|---|
| 4,349,121 | A | 9/1982 | Lafferty | |
| D291,738 | S | 9/1987 | Orlowski | |
| 4,753,367 | A | 6/1988 | Miller et al. | |
| 4,992,018 | A | 2/1991 | Prout et al. | |
| D323,912 | S | 2/1992 | Delmerico | |
| 5,094,358 | A | 3/1992 | Serio, Sr. | |
| 5,103,994 | A | 4/1992 | Doxey et al. | |
| 5,104,198 | A | 4/1992 | Prout et al. | |
| 5,104,200 | A | 4/1992 | Prout et al. | |
| 5,160,063 | A | 11/1992 | Bailey | |
| 5,184,836 | A | 2/1993 | Andrews, Jr. | |
| 5,261,562 | A * | 11/1993 | Prout et al. | 220/771 |
| D345,837 | S | 4/1994 | Bean | |
| D347,095 | S | 5/1994 | Apps et al. | |
| 5,377,858 | A | 1/1995 | Morris, Sr. | |
| D355,741 | S | 2/1995 | Craft et al. | |
| 5,415,314 | A | 5/1995 | McCollum | |
| 5,445,397 | A | 8/1995 | Evans | |
| D365,428 | S | 12/1995 | Prout et al. | |
| 5,474,341 | A | 12/1995 | Putman et al. | |
| 5,503,292 | A | 4/1996 | Cuccharia | |
| 5,538,158 | A | 7/1996 | Prout et al. | |
| 5,547,104 | A | 8/1996 | Parker | |
| 5,555,996 | A | 9/1996 | Lang-Ree et al. | |
| 5,582,322 | A | 12/1996 | Prout et al. | |
| 5,585,419 | A | 12/1996 | Prout et al. | |
| D388,577 | S | 12/1997 | Rehrig et al. | |
| D398,120 | S | 9/1998 | Rehrig et al. | |
| 5,816,591 | A | 10/1998 | Parker et al. | |
| D401,727 | S | 11/1998 | Weideman et al. | |
| 5,881,901 | A | 3/1999 | Hampton | |
| 5,886,068 | A | 3/1999 | Prout et al. | |
| 5,899,468 | A | 5/1999 | Apps et al. | |
| 5,947,295 | A | 9/1999 | Lutin | |
| D416,367 | S | 11/1999 | Dickinson et al. | |
| D429,398 | S | 8/2000 | Wysocki | |
| D445,228 | S | 7/2001 | Apps et al. | |
| 6,276,557 | B1 | 8/2001 | Wysocki | |
| D465,348 | S | 11/2002 | Lucatello | |
| D471,336 | S | 3/2003 | Tuduri | |
| D471,685 | S | 3/2003 | Taylor et al. | |
| D478,197 | S | 8/2003 | Raghunathan | |
| D491,328 | S | 6/2004 | Aiken et al. | |
| 6,918,508 | B2 | 7/2005 | Hwang | |
| D515,313 | S | 2/2006 | Uffner et al. | |
| 7,017,773 | B2 | 3/2006 | Gruber et al. | |
| 7,048,346 | B2 | 5/2006 | Saravis | |
| 7,114,631 | B2 | 10/2006 | Aiken et al. | |
| 7,121,564 | B2 | 10/2006 | Hassell | |
| D532,173 | S | 11/2006 | Aiken et al. | |
| D535,448 | S | 1/2007 | Kilduff et al. | |
| 7,287,665 | B2 | 10/2007 | Meissen et al. | |
| D577,170 | S | 9/2008 | Meers | |
| D600,943 | S | 9/2009 | Austin et al. | |
| D600,944 | S | 9/2009 | McConnell et al. | |
| D624,723 | S | 9/2010 | Raghunathan et al. | |
| D643,174 | S | 8/2011 | Raghunathan et al. | |
| D654,723 | S | 2/2012 | Gormezano | |
| D656,730 | S | 4/2012 | Son | |
| 8,360,445 | B2 | 1/2013 | Meers et al. | |
| 8,366,156 | B2 | 2/2013 | Mercier et al. | |
| 8,424,715 | B2 | 4/2013 | Aiken et al. | |
| 8,485,381 | B2 | 7/2013 | Raghunathan et al. | |
| 8,485,382 | B2 | 7/2013 | Raghunathan et al. | |
| 8,881,930 | B2 | 11/2014 | Banik | |
| 2003/0189340 | A1 | 10/2003 | Kitzis | |
| 2004/0074913 | A1 | 4/2004 | McDade et al. | |
| 2004/0222231 | A1 * | 11/2004 | Aiken et al. | 220/759 |
| 2005/0029763 | A1 | 2/2005 | Hassell | |
| 2006/0065657 | A1 | 3/2006 | Wong | |
| 2006/0076260 | A1 | 4/2006 | Luburic | |
| 2006/0236612 | A1 | 10/2006 | Sheng et al. | |
| 2009/0107998 | A1 | 4/2009 | Meissen | |
| 2009/0223965 | A1 | 9/2009 | Raghunathan et al. | |
| 2011/0024430 | A1 | 2/2011 | Meissen et al. | |
| 2011/0049151 | A1 | 3/2011 | Raghunathan et al. | |
| 2011/0049152 | A1 | 3/2011 | Raghunathan et al. | |
| 2013/0032597 | A1 | 2/2013 | Anderson | |
| 2013/0119625 | A1 | 5/2013 | Foster | |

FOREIGN PATENT DOCUMENTS

| | | | |
|---|---|---|---|
| CA | 2418583 | A1 | 8/2003 |
| CA | ID125054 | | 4/2009 |
| CA | ID126678 | | 4/2009 |
| CA | 2624658 | A1 | 9/2009 |
| CA | 2624663 | A1 | 9/2009 |
| CA | 2636306 | A1 | 9/2009 |
| GB | 2453055 | A | 3/2009 |

* cited by examiner

FIG. 8
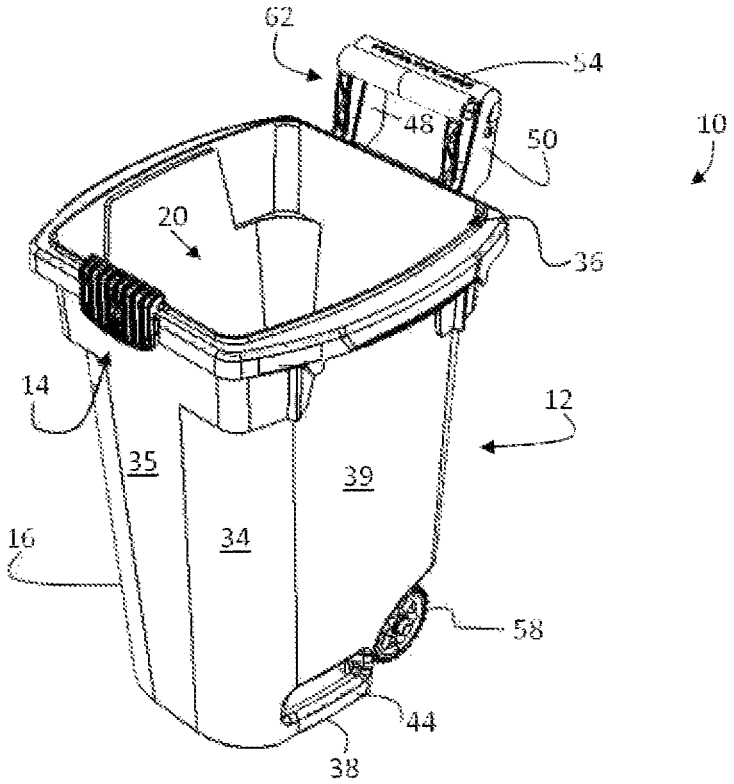
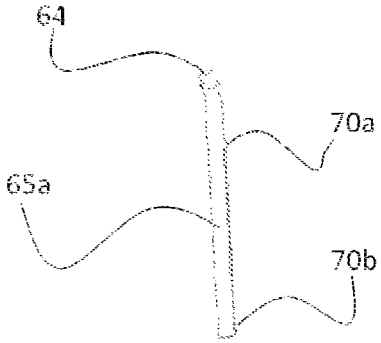
FIG. 9
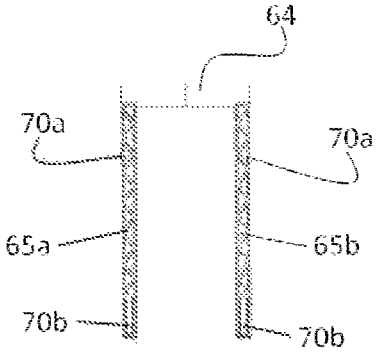
FIG. 10

REFUSE CONTAINER WITH LOCKING LID

RELATED APPLICATION

This present application is a divisional application of U.S. patent application Ser. No. 13/945,429, filed Jul. 18, 2013, now issued as U.S. Pat. No. 8,881,930, which claims the benefit of U.S. Provisional Patent Application No. 61/675,587 filed Jul. 25, 2012, and which the contents of are incorporated herein.

FEDERALLY SPONSORED RESEARCH OR DEVELOPMENT

N/A

TECHNICAL FIELD

The present invention relates to containers for storing refuse, and particularly to containers configured for facilitating easier filling and emptying.

BACKGROUND OF THE INVENTION

In modern, urban communities, refuse containers are used to store accumulated household refuse until such household refuse can be collected by garbage trucks or the like. Typically, such refuse containers includes a lid for concealing the household refuse collected therein, as well as to prevent wild animals from accessing this household refuse. With some containers, the lid is integrally mounted to a storage bin which contains the collected household refuse. Such containers, however, are awkward to use. For example, available latching mechanisms continue to be prone to opening by wild animals.

Examples of prior refuse containers of this type can be found in U.S. Patent Application Publication Nos. 2009/0223965 A1, 2011/0049152 A1 and 2011/0049151 A1. All these applications are incorporated by reference as if fully set forth herein.

The present invention is provided to solve the problems discussed above and other problems, and to provide advantages and aspects not provided by prior refuse containers of this type. A full discussion of the features and advantages of the present invention is deferred to the following detailed description, which proceeds with reference to the accompanying drawings

SUMMARY OF THE INVENTION

A first aspect of the present invention is directed to a refuse container. The refuse container comprises container assembly. The container assembly comprises a bin, a lid, an extensible handle, and a locking mechanism. The bin defines a cavity. The lid is rotatably coupled to the bin at a pivot point and has a generally horizontal axis of rotation and is movable relative to the bin between an open position providing access to the cavity and a closed position inhibiting access to the cavity. The extensible handle assembly is located adjacent the pivot point and is telescopingly movable from a lower retracted position to an upper extended position above an upper surface of the lid. The locking mechanism is for maintaining the lid in the closed position and is located opposite the extensible handle assembly.

This aspect of the invention may include one or more of the following features, alone or in any reasonable combination. The refuse container may further comprise a pair of wheels separated by a portion of the refuse container and located below and substantially in line with the extensible handle assembly. The wheels may have an axis of rotation substantially parallel to the axis of rotation of the lid wherein user intervention may be provided to pull a portion of the extensible handle assembly upwardly and tip the refuse container clockwise according to a right-hand orientation over the wheels for transport of the refuse container on the wheels. The refuse container may further comprise a first slot located on the bin and below the pivot point of the lid for receiving a first upright post of the extensible handle assembly wherein the first upright post is extensible from the first slot. The refuse container may further comprise a first retainer on the first upright post for frictionally engaging a portion of the bin to prevent over-travel of the first upright post upwardly within the first slot. The refuse container may further comprise a second retainer on the first upright post for frictionally engaging a portion of the bin to prevent over-travel of the first upright post downwardly within the first slot. The refuse container may further comprise a second slot located on the bin and below the pivot point of the lid for receiving a second upright post joined to the first upright post by a crossbar handle wherein the second upright post is extensible from the second slot via upward force on the crossbar handle. The refuse container may further comprise a third retainer on the second upright post for frictionally engaging a portion of the bin to prevent over-travel of the second upright post upwardly within the second slot. The refuse container may further comprise a fourth retainer on the second upright post for frictionally engaging a portion of the bin to prevent over-travel of the second upright post downwardly within the second slot. The refuse container may further comprise a fixed second handle integrally formed with the bin having the pivot point of the lid thereon wherein the first and second upright posts fit within third and fourth upright posts of the fixed handle. The refuse container may further comprise a pair of fixed bottom handles located on opposing sides of the bin and integrally formed therewith, each fixed bottom handle including a recess formed in the bin and extending inwardly into the cavity and a cross member spanning the recess, the pair of fixed bottom handles substantially vertically aligned with the wheels. The locking mechanism may further comprise a spring-loaded locking mechanism for maintaining the lid in the closed position located opposite the handle wherein the spring-loaded locking mechanism comprises a rotating latch pivotally joined to the lid and extending downwardly therefrom over a portion of the front wall having a catch and a moveable button assembly having a keeper extending outwardly relative to the front wall and selectively engaging the catch to maintain the spring-loaded locking mechanism in a locked position wherein the rotating latch is maintained in a locked position and the lid is retained in the closed position, the moveable button being selectively movable against a spring-force to disengage the keeper from the catch wherein the rotating latch is in an unlocked position and the lid may be selectively pivoted to the open position.

A second aspect of the present invention is directed to a refuse container. The refuse container comprises a container assembly including a bin, a lid, a bottom handle, and a pair of wheels. The bin has opposing front and rear walls joined by opposing sidewalls defining a cavity. The lid is rotatably coupled to the bin at a pivot point and movable relative to the bin between an open position providing access to the cavity and a closed position inhibiting access to the cavity. The bottom handle is integrally molded with the bin located on one of the sidewalls. The pair of wheels is located at the bottom of the refuse container adjacent the rear wall of the bin and having an axis of rotation transverse to the opposing sidewalls, wherein the bottom handle is located forward of the pair of wheels between the pair of wheels and the front wall.

This aspect of the invention may include one or more of the following features, alone or in any reasonable combination. The bottom handle may be substantially horizontally aligned with the pair of wheels. The refuse container may further comprise a second bottom handle located on an opposing sidewall to the first bottom handle and generally vertically and horizontally aligned therewith. Each bottom handle may comprise a recess formed in the bin and extending inwardly into the cavity and have a substantially horizontal cross member spanning the recess to form a grabbing location to accommodate a user's hand around the cross member and into the recess. Each bottom handle may be in a fixed location. The refuse container may further comprise an extensible handle assembly located adjacent the pivot point, vertically disposed above the wheel axis of rotation, and movable from a lower retracted position to an upper extended position above an upper surface of the lid. The refuse container may further comprise a spring-loaded locking mechanism for maintaining the lid in the closed position located opposite the handle. The spring-loaded locking mechanism my comprise a rotating latch pivotally joined to the lid and extending downwardly therefrom over a portion of the front wall and having a catch and a moveable button assembly having a keeper extending outwardly relative to the front wall and selectively engaging the catch to maintain the spring-loaded locking mechanism in a locked position wherein the rotating latch is maintained in a locked position and the lid is retained in the closed position, the moveable button being selectively movable against a spring-force to disengage the keeper from the catch wherein the rotating latch is in an unlocked position and the lid may be selectively pivoted to the open position.

A third aspect of the present invention is directed refuse container comprising a container assembly. The container assembly comprises a bin, a lid, a handle, and a dual force locking system located opposite the handle. The bin has opposing front and rear walls joined by opposing sidewalls defining a cavity. The lid is rotatably coupled to the bin at a pivot point and movable relative to the bin between an open position providing access to the cavity and a closed position inhibiting access to the cavity. The handle is located adjacent the pivot point. The dual force locking system is for transferring the lid from a closed and locked condition to a closed and unlocked condition. The dual force locking system comprises a first lock assembly requiring a first user initiated force to unlock the lid from attachment of the lid to the bin and a second lock assembly requiring a second user initiated force to disengage the lid from releasable attachment to the bin wherein the first user initiated force may be greater than the second user initiated force.

The first lock assembly may further comprise a spring-loaded locking mechanism. The spring-loaded locking mechanism is for maintaining the lid in the closed position and is located opposite the handle. The spring-loaded locking mechanism comprises a rotating latch and a moveable arm assembly. The rotating latch is pivotally joined to the lid and extends downwardly therefrom over a portion of the front wall and having a catch. The moveable button assembly has a keeper extending outwardly relative to the front wall and selectively engaging the catch to maintain the spring-loaded locking mechanism in a locked position wherein the rotating latch is maintained in a locked position and the lid is retained in the closed position. The moveable button is selectively movable against a spring-force to disengage the keeper from the catch wherein the rotating latch is in an unlocked position.

The second lock assembly may comprise a second catch and a second keeper. The second catch is on the latch. The second keeper is on the bin and engages the second catch in the closed and unlocked condition wherein the second user initiated force is used to release the second catch from the second keeper wherein the lid may be selectively pivoted to the open position.

This aspect of the invention may include one or more of the following features, alone or in any reasonable combination. The rotating latch may terminate at a convexly arcuate edge spaced vertically downwardly from the catch. The moveable button may have a lower concavely arcuate surface generally aligned with the convexly arcuate edge of the rotating latch. The refuse container may further comprise a spring member in engagement with the moveable button for biasing the moveable button downwardly wherein a downward force is provided on the keeper to remain in active engagement with the catch and wherein an upward user intervention force may be selectively provided to the lower concavely arcuate to disengage the keeper from the catch. The moveable button may be slidably mounted to the bin and frictionally retained thereto. The spring member may engage a portion of the bin to provide a biasing force between the bin and the moveable button wherein the upward user intervention force overcomes the biasing force to provide movement to the moveable button. The latch may comprise a tongue separated from a protective portion by a bend forming an angle between the tongue and the protective portion wherein the tongue terminates at a lower end with the convexly arcuate edge, and the tongue terminates at an upper end at the bend. The tongue may extend downwardly to partially conceal the moveable button. The tongue may have an exposed outward surface and an opposing inward surface which confronts the front wall of the bin, and the catch may extend outwardly from the inward surface towards the front wall of the bin. The protective portion may extend over a latch axis of rotation about which the latch pivots. The keeper on the moveable button may extend towards the inward surface of the tongue for engagement with the catch.

BRIEF DESCRIPTION OF THE DRAWINGS

The invention will be better understood when consideration is given to the following detailed description thereof. Such description makes reference the annexed drawings wherein:

FIG. 8 is a perspective view of the refuse container of FIG. 1 with the lid removed;

FIG. 9 is a side view of an extensible handle for the refuse container of FIG. 1;

FIG. 10 is a front view of the extensible handle;

DETAILED DESCRIPTION OF PREFERRED EMBODIMENTS

Figure 1:
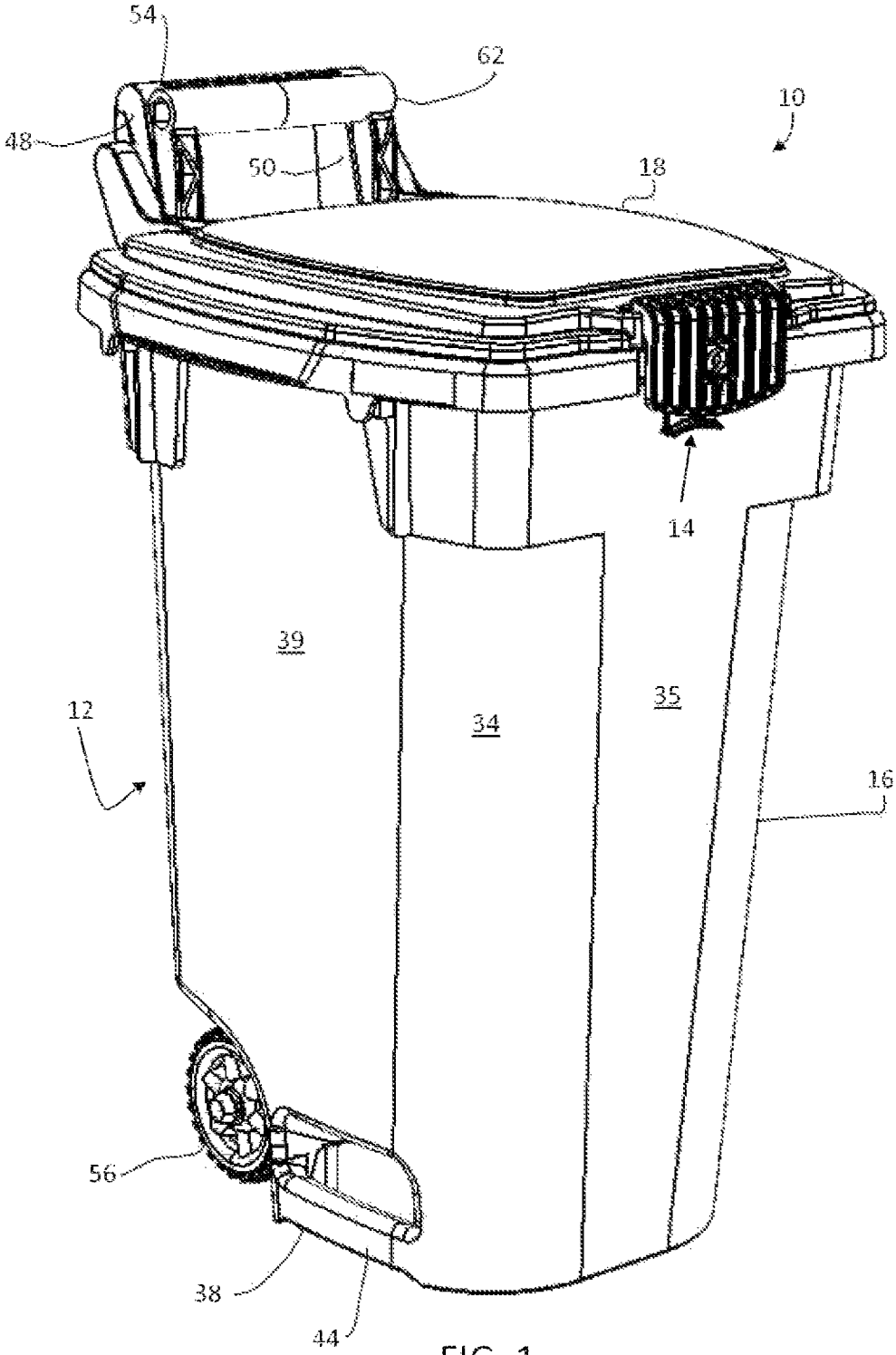
FIG. 1 is a front perspective view of an embodiment of a refuse container of the present invention.
Figure 2:
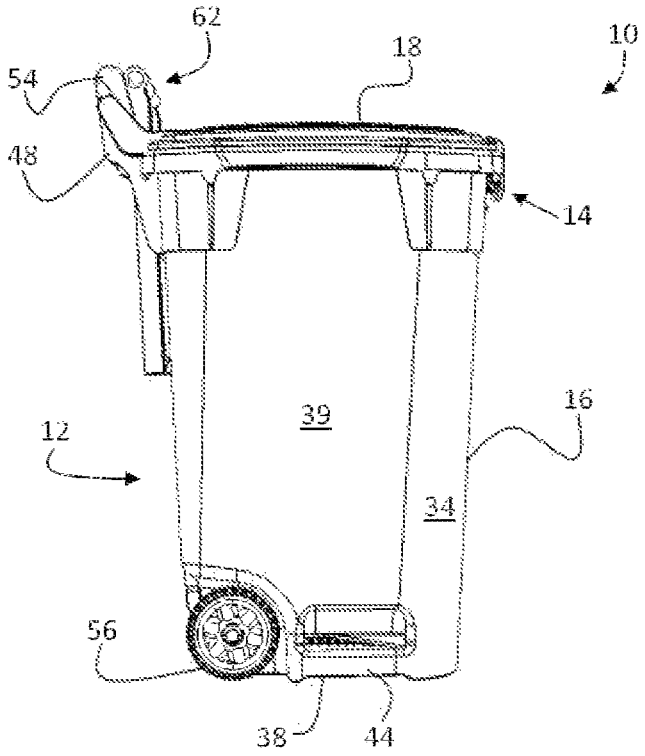
FIG. 2 is a side elevation view of one side of the refuse container of FIG. 1.
Figure 3:
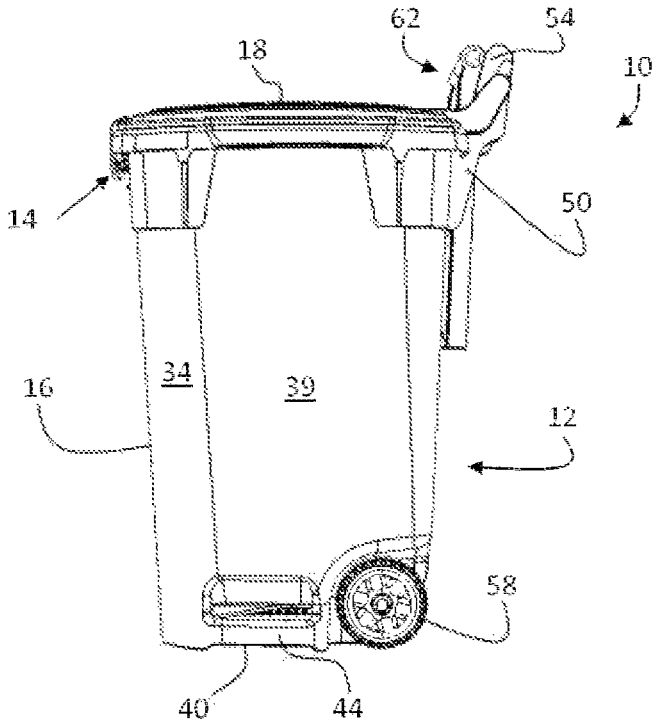
FIG. 3 is an opposite side view of the refuse container of FIG. 1.
Figure 4:
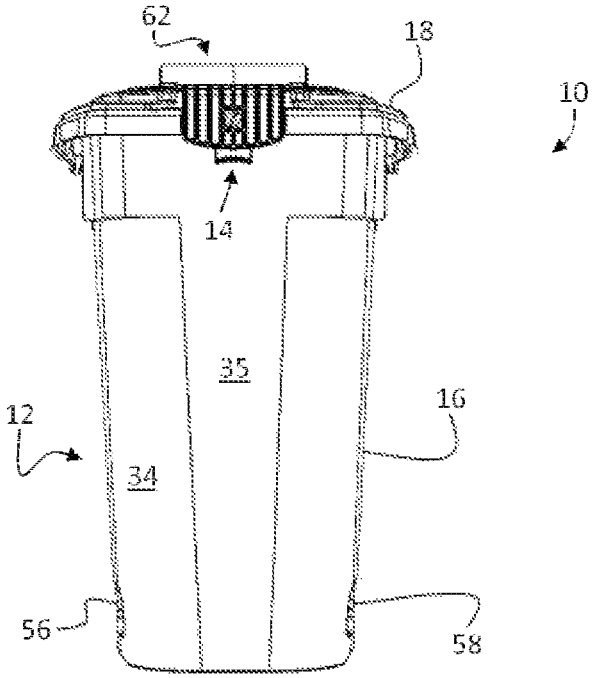
FIG. 4 is a front elevation view of the refuse container of FIG. 1.
Figure 5:
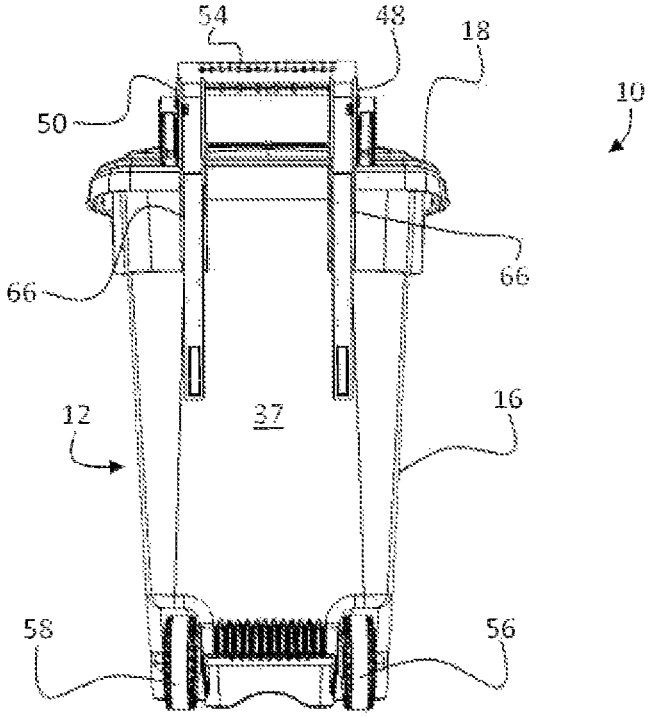
FIG. 5 is a rear elevation view of the refuse container of FIG. 1.
Figure 6:
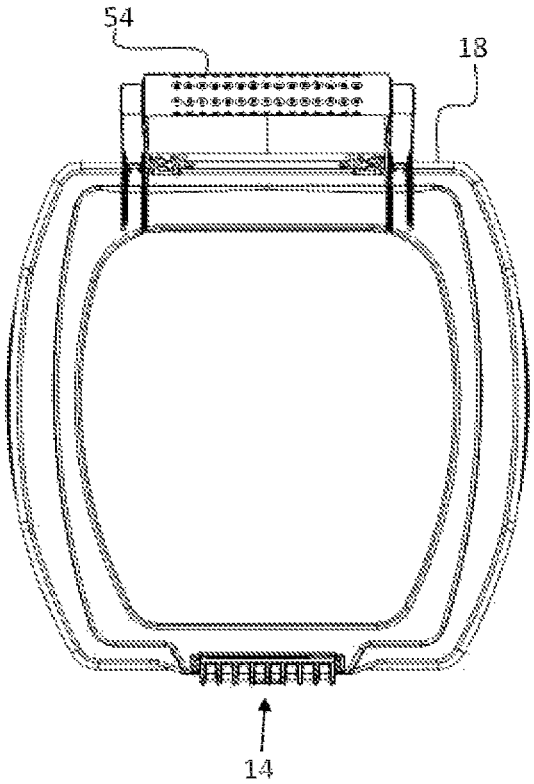
FIG. 6 is a top plan view of the refuse container of FIG. 1.
Figure 7:
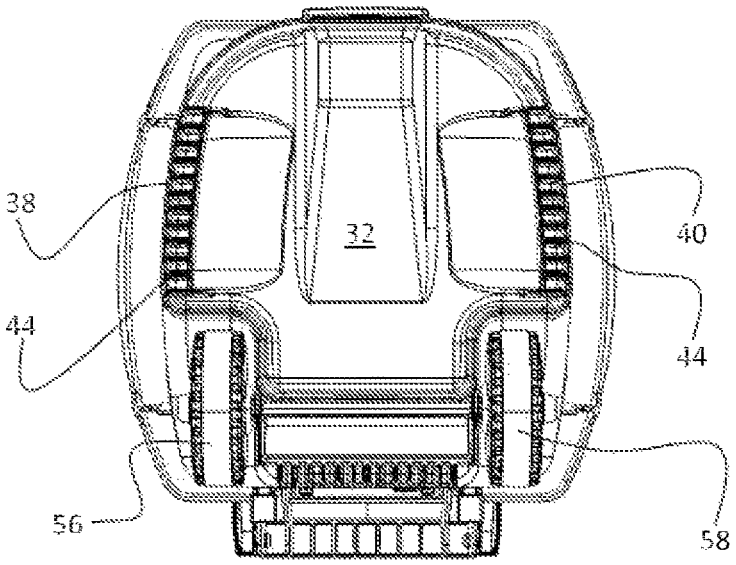
FIG. 7 is a bottom plan view of the refuse container of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the figures, a refuse container 10 of the present invention is generally illustrated. Descriptions of spatial disposition one element relative to another are provided in the context of a refuse container 10 disposed in a vertically upright and self-supporting position, and disposed on a substantially horizontal reaction surface.

The refuse container 10 includes a container assembly 12 and a locking mechanism 14. For example, the container 10 is manufactured by high pressure injection molding.

The container assembly 12 includes a bin 16 and a lid 18. The lid 18 is coupled to the bin 16. For example, the material of the bin 16 and the lid 18 is high density polyethylene.

The bin 16 defines a cavity 20. The bin 16 includes a lip which defines an opening 36 for effecting communication between the cavity 20 and the environment external to the bin 16 when the lid 18 is in an open position. For example, the cavity 20 is configured for storing material including household organic waste.

With respect to the bin 16, the bin 16 includes a bottom wall 32 and a continuous upstanding wall 34 extending between the bottom wall 32 and the lip. For example, with respect to the continuous wall 34, the continuous wall 34 includes a front wall 35 separated from a rear wall 37 by a pair of opposing sidewalls 39. The continuous wall 34 includes interior and exterior surfaces. A rim extends peripherally about the perimeter of the lip. For example, the rim includes a seating surface configured to co-operate with the lid 18, as will be explained below. For example, the seating surface extends peripherally about the perimeter of the lip.

The interior surface of the continuous sidewall, the interior surface is tapered so as to facilitate nesting of an identical container within the container 10, and thereby facilitate stacking of multiple identical containers 10.

The external surface of the continuous sidewall 34, a pair of bottom handles 38, 40 are fixedly mounted on the opposing sidewalls 39 of the external surface of the continuous wall 34. The bottom handles 38,40 are configured to be grasped by a human operator for effecting lifting of the container 10. The bottom handles 38,40 are preferably integrally molded with or into the opposing sidewalls 39 at a lower portion thereof, adjacent the bottom wall 32, such that the handles 38,40 are generally vertically and horizontally aligned with each other. Each bottom handle 38,40 comprises a recess formed in the bin 16 and extending inwardly into the cavity 20 and a substantially horizontal cross member 44 spanning the recess. This arrangement forms a grabbing location to accommodate a user's hand around the cross member 44 and into the recess for easy lifting from the bottom of the container 10. The bottom handles 38 allow the refuse container 10 to be safely held in an upside-down position during unloading. Often waste haulers hold prior art refuse containers by the wheels when the haulers empty the containers into their trucks. The bottom handles 38 eliminate the need for such mishandling.

The external surface 42 of the continuous wall 34 includes a pair of brackets 48,50 mounted to the rear wall 37 of the continuous sidewall 34, preferably integrally molded therewith. A fixed handle 54 extends between the brackets 48,50 which serve as a pair of upright posts. The fixed handle 54 is integrally formed with the bin 16 and is provided for grasping by a human operator for effecting lifting of the container. Alternatively, where the container 10 is provided with wheels 56,58, the fixed handle 54 facilitates grasping by a human operator for effecting rolling movement of the container 10 across a reaction surface.

The lid 18 is rotatably coupled to the bin 16 at a pivot point having a generally horizontal lid axis of rotation. The lid 18 is moveable relative to the bin 16 between a lid open position providing access to the cavity 20 wherein the lid 16 may rest on the fixed handle 54 and a lid closed position inhibiting access to the cavity 20. For example, such rotational coupling can be accomplished by pivot pins incorporated in one of the lid 18 or the bin 16 and received within respective receptacles in the other one of the lid 18 or the bin 16, or through external pivot pins received within receptacles provided in each one of the lid 18 and the bin 16. Preferably, the lid pivot point is located on portions of the brackets 48,50.

The lid 18 is configured for movement, relative to the bin 16, between an open position and a closed position. For example, the lid extends between and is rotatably coupled to each one of the brackets 48,50. With respect to the lid 16, when the lid 16 is in the open position, depositing of household organic waste into the cavity 20 can be effected. As a further example, when the lid 16 is open, removal, from the cavity 20, of the contents of the cavity 20 is enabled. For example, when the lid 18 is in the closed position, removal or egress, from the cavity 20, of the contents of the cavity 20 is inhibited. As a further example, when the lid 18 is in the closed position, the contents of the cavity 20 are hidden from view. As a further example, when the lid 18 is in the closed position, egress of odors, from the cavity 20, and from the materials within the cavity 20, is inhibited.

Figure 11:
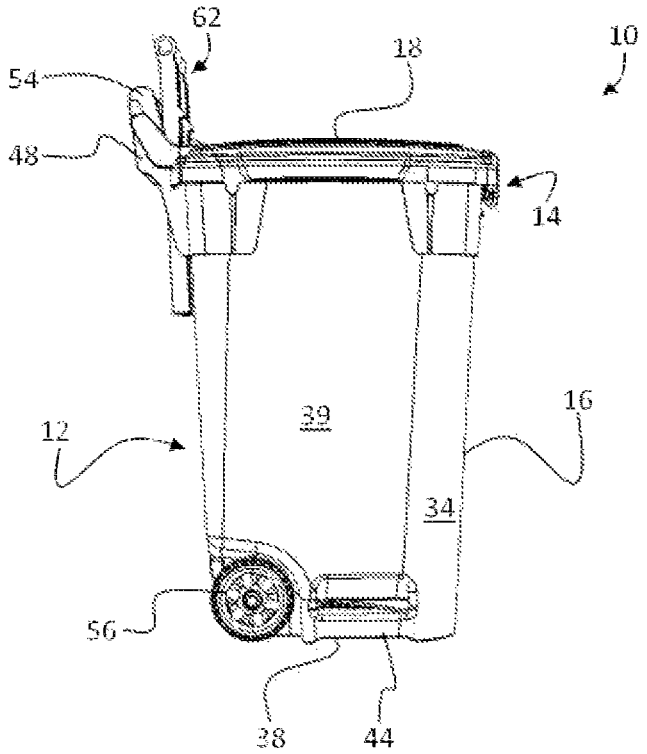
FIG. 11 is a side view of the refuse container of FIG. 1 with the extensible handle partially extended.
Figure 12:
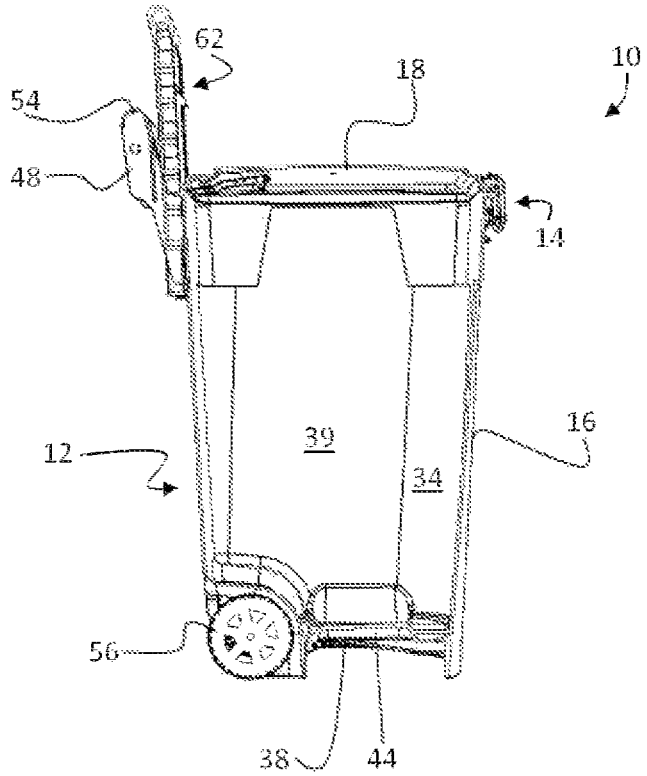
FIG. 12 a cross-sectional view of the refuse container of FIG. 1 with the extensible handle fully extended.
Figure 13:
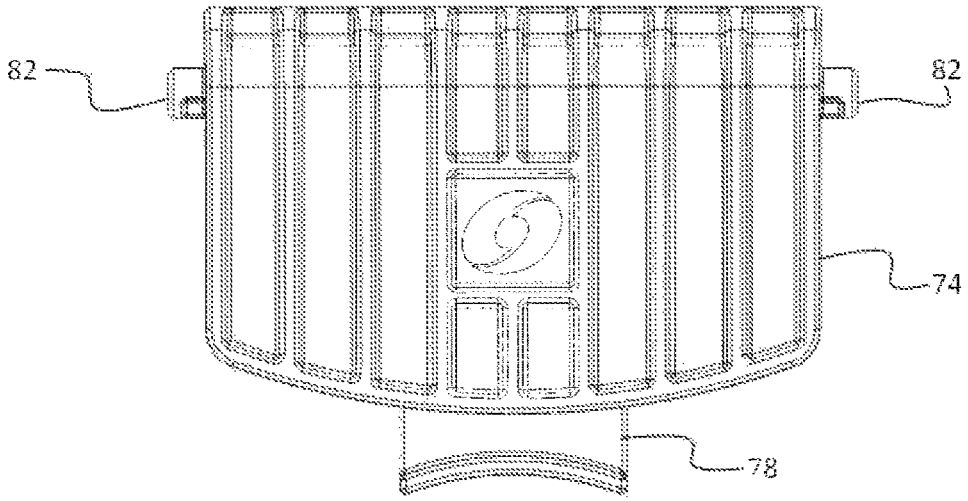
FIG. 13 is a front view of a locking mechanism of the refuse container of FIG. 1.
Figure 14:
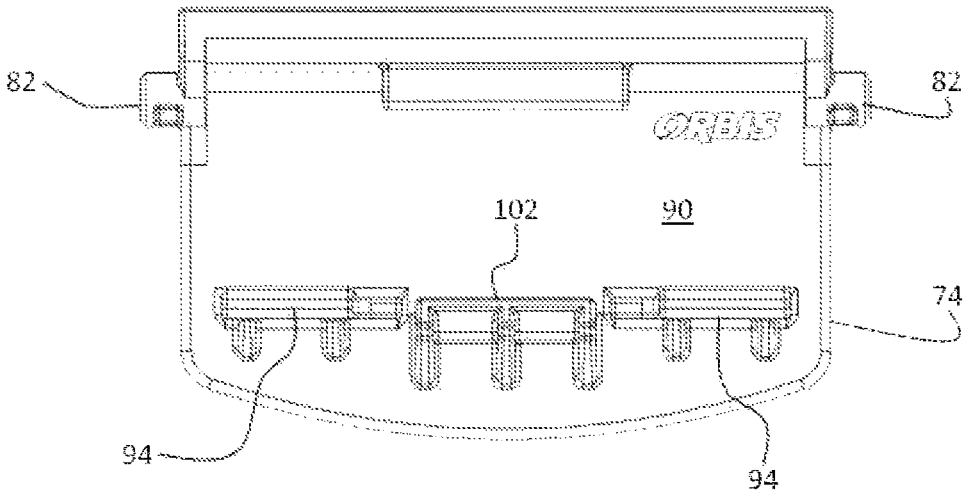
FIG. 14 is a rear view of a latch.
Figure 15:
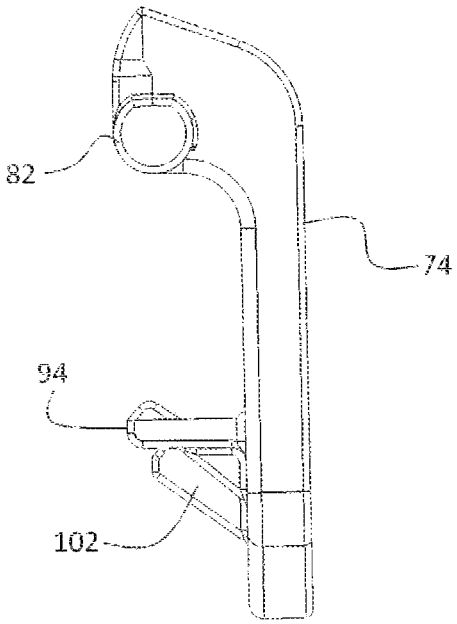
FIG. 15 is a side view of the latch.
Figure 16:
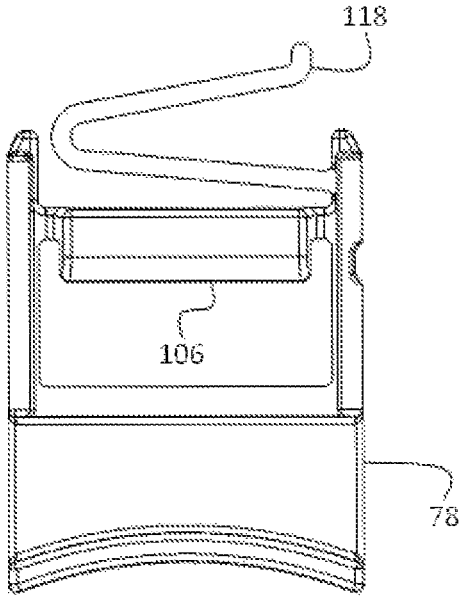
FIG. 16 is a front view of a release button.

An extensible handle assembly located adjacent the pivot point between the lid 18 and the bin 16 and movable from a lower retracted position to an upper extended position above an upper surface of the lid 18 (see FIGS. 11 and 12). The extensible handle assembly includes an extensible handle 62 which as a generally horizontal crossbar 64 joining opposing upright posts 65*a,b*.

The extensible handle assembly includes telescopic movement to extend from the lower retracted position to the upper extended position. The upright posts reside in and traverse within slots 66 located on the bin 16 and below the lid pivot point wherein a first upright post 65*a* is extensible from a first slot, and the opposing second upright post 65*b* is extensible from a second slot. Each upright 65*a,b* has a pair of retainers 70*a,b* which frictionally engage a portion of the bin 16 to prevent over-travel of the upright posts 65*a,b* upwardly and downwardly within the slots 66. The slots 66 are preferably located within the brackets 48,50 supporting the fixed handle 54.

The locking mechanism 14 comprises a dual force locking system. The dual force locking system is for transferring the lid from a closed and locked condition to a closed and unlocked condition. As will be described in more detail below a primary or first lock assembly uses a spring-loaded mechanism which requires a primary or first user initiated force to unlock the lid from attachment of the lid to the bin, and a secondary or second lock assembly uses frictional engagement between the bin and the lid which requires a secondary or second user initiated force to disengage the lid from releasable attachment to the bin wherein the first user initiated force may be greater than the second user initiated force. Generally speaking, the primary lock assembly provides a more secure releasable attachment of the lid 18 to the bin 16. The bin 16 may be supplied without the primary lock.

The locking mechanism 14 includes a latch 74 and a release, such as a moveable button which preferably includes an elastically-biased release button 78, such that the locking assembly is a spring-loaded locking assembly. The latch 74 is coupled (for example, mounted) to one of the bin 16 and the lid 18, preferably pivotably mounted to the lid 18 by pivot pins 82 on the latch 74 fit within corresponding apertures 86 located on the lid 18 apertures. Thus, the latch 74 may be rotated about a pivot axis defined by a structural combination of the pins 82 and the apertures 86.

A back or inward surface 90 of the latch 74 opposite an exposed outer surface includes a plurality of keepers extending outwardly therefrom towards the bin 16. The inward surface confronts the front wall 35 of the bin 16.

Figure 17:
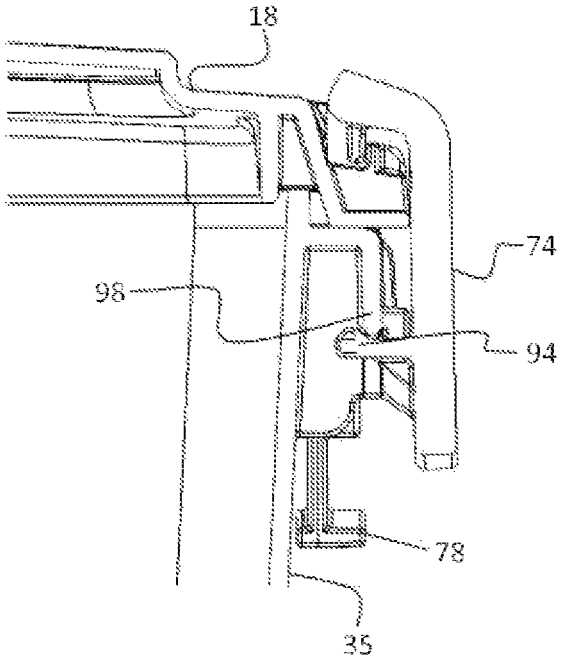
FIG. 17 is a magnified partial cross-sectional view of the refuse container of FIG. 1 showing the latch engaged with a portion of the refuse container bin.
Figure 18:
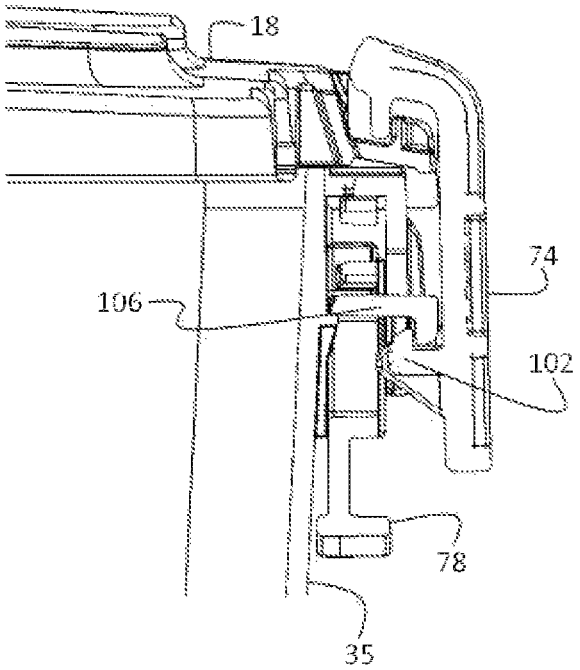
FIG. 18 is a magnified partial cross-sectional view of the refuse container of FIG. 1 showing the latch engaged with a portion of the release button.
Figure 19:
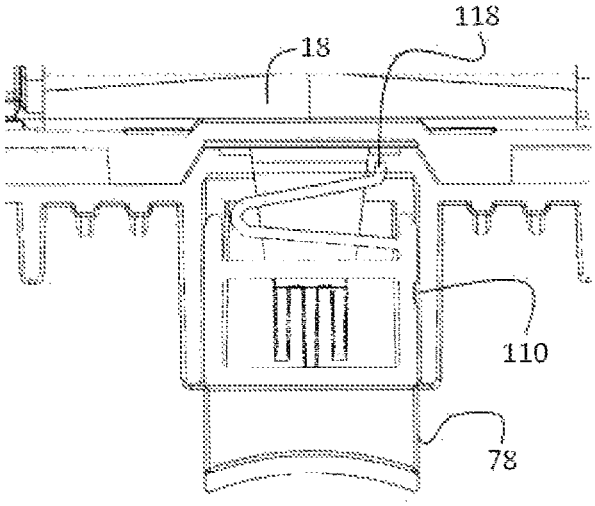
FIG. 19 is a front view of the release button shown with the latch removed.
Figure 20:
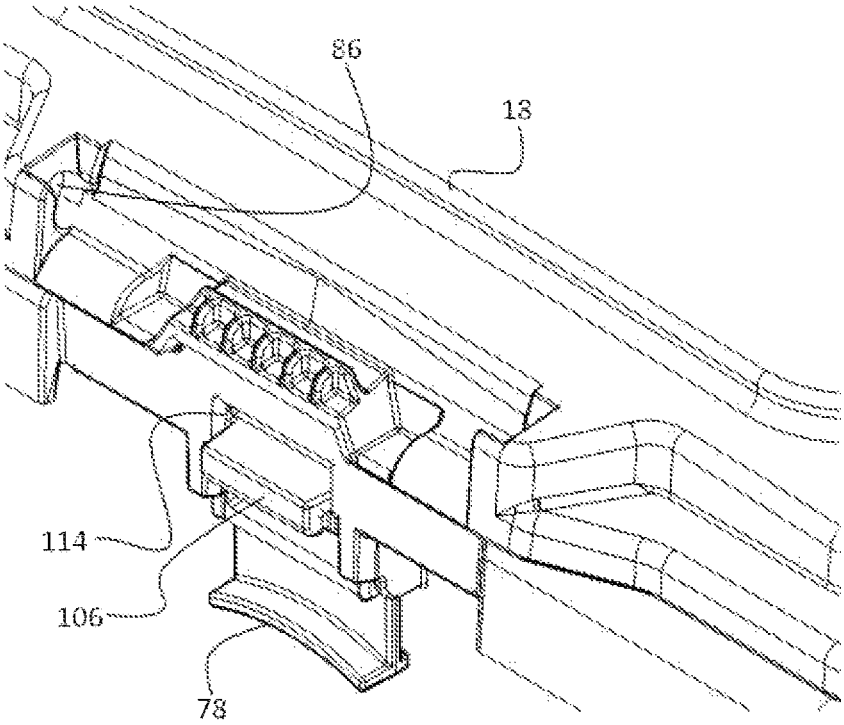
FIG. 20 is a magnified partial perspective view of the refuse container of FIG. 1 shown with the latch removed.

In a lid closed and unlocked position, the secondary locking system provides a pair of outer catches 94 frictionally engaging corresponding bin keepers 98 on the bin 16 (see. e.g., FIG. 17). In the lid closed and unlocked position, a frictional force caused by the frictional engagement between the outer catches 94 and the corresponding bin keepers 98 is of a magnitude that can be overcome by rotating the latch 74 about the pivot axis. This is the secondary force described above. Accordingly, barb portions of the outer catches 94 and the corresponding bin keepers 98 have a depth and an angle of engagement that allow the frictional force to be relatively easily overcome through user intervention.

The primary locking system provides another catch 102 located between the pair of outer catches 94. In a lid closed and locked position, a corresponding keeper 106 located on the release button 78 selectively frictionally engages the catch 102 on the latch 74. In the lid closed and locked position, the frictional engagement creates a frictional force between the catch 102 on the latch 74 and the keeper 106 of a magnitude such that it cannot be overcome without distorting one or more of the lid 18, latch 74, and the release button 78. Accordingly, barb portions on the catch 102 and the corresponding keeper 106 have a depth and an angle of engagement that allow the frictional force to be relatively difficult to overcome, especially relative to the frictional force between the outer catches 94 and the corresponding bin catches 98 (see, e.g., FIG. 17).

The latch 74 terminates at a convexly arcuate edge spaced vertically downwardly from the catch 102. A tongue portion of the catch 94 extends upwardly from the convexly arcuate edge and is separate from a protective portion of the latch by a bend which directs the protective portion of the latch towards the lid 18. The tongue at least partially conceals the release while the protective portion extends over the latch axis of rotation.

The release button 78 is attached to the bin 16 beneath a portion of the latch 74 which extends downwardly from the lid 18. The release button 78 traverses within a channel 110 or slot integrally molded in the bin 16. The keeper 106 on the release button 78 extends through an aperture 114 in the channel 110. This arrangement serves to retain the release button 78 to the bin 16 and allows the keeper 106 to engage the latch 74. The release button 78 also includes a spring 118 which may contribute, along with a gravitational force, to a biasing force on the release button 78 wherein the keeper 106 is biased in a downward position to remain in an active engagement with the catch 102 on the latch 74 to retain the lid 18 in the closed and locked position. The release button 78 has a lower concavely arcuate edge spaced vertically downwardly from the keeper. This surface is generally aligned with the convexly arcuate edge of the latch 74.

The lid is transferred to the lid closed and unlocked position by pressing upwardly on the concavely arcuate edge of the release button 78 to overcome the gravitational force and the resistant spring force provided by the spring 118 as it engages a portion of the bin 16. This is the primary user force described above. The user intervention overcomes a spring force by compressing the spring 118, as preferably an uppermost portion of the spring 118 engages a portion of the bin 16. The release button 78 is pressed upwardly until the keeper 106 on the release button 78 is moved out of alignment with the catch 102 on the latch 74 and the keeper 106 may be disengaged from the catch 102.

The lid 18 can then be transferred to a lid open and unlocked position by overcoming the relatively low frictional force retaining the pair of outer catches 94 to the bin keepers 98 on the bin 16.

The embodiment of the refuse container 10 illustrated also includes a pair of wheels 56,58 separated by a portion of the refuse container 10, preferably a lowermost portion of the bin 16. The wheels 56,58 are located below and substantially in line with the extensible handle assembly and substantially horizontally aligned with the bottom handles 38,40. A wheel axis of rotation is substantially parallel to a lid 18 axis of rotation. User intervention is used to pull a portion of the extensible handle assembly, typically the crossbar, and tip the refuse container clockwise according to a right-hand orientation over the wheel 56,58 for transport of the refuse container 10 on the wheels 56,58.

Although the disclosure describes and illustrates various embodiments of the invention, it is to be understood that the invention is not limited to these particular embodiments. Mans variations and modifications will now occur to those skilled in the art of molded refuse containers. The scope of protection is only limited by the scope of the accompanying Claims.

What is claimed is:

1. A refuse container comprising:

a container assembly comprising:

a bin defining a cavity;

a lid rotatably coupled to the bin at a pivot point having a generally horizontal lid axis of rotation and movable relative to the bin between an open position providing access to the cavity and a closed position inhibiting access to the cavity;

an extensible handle assembly located adjacent the pivot point and telescopingly movable from a lower refracted position to an upper extended position above an upper surface of the lid; and a locking mechanism for maintaining the lid in the closed position located opposite the extensible handle assembly.

2. The refuse container of claim 1 further comprising:

a pair of wheels separated by a portion of the refuse container and located below and substantially in line with the extensible handle assembly and having a wheel axis of rotation substantially parallel to the lid axis of rotation wherein user intervention is used to pull a portion of the extensible handle assembly and tip the refuse container clockwise according to a right-hand orientation over the wheels for transport of the refuse container on the wheels.

3. The refuse container of claim 2 further comprising:

a first slot located on the bin and below the lid pivot point for receiving a first upright post of the extensible handle assembly wherein the first upright post is extensible from the first slot.

4. The refuse container of claim 3 further comprising:

a first retainer on said first upright post for frictionally engaging a portion of the bin to prevent over-travel of the first upright post upwardly within the first slot.

5. The refuse container of claim 4 further comprising:

a second retainer on said first upright post for frictionally engaging a portion of the bin to prevent over-travel of the first upright post downwardly within the first slot.

6. The refuse container of claim 5 further comprising:

a second slot located on the bin and below the lid pivot point for receiving a second upright post joined to the first upright post by a crossbar handle wherein the second upright post is extensible from the second slot via upward force on the crossbar handle.

7. The refuse container of claim 6 further comprising:

a third retainer on the second upright post for frictionally engaging a portion of the bin to prevent over-travel of the second upright post upwardly within the second slot.

8. The refuse container of claim 7 further comprising:

a fourth retainer on the second upright post for frictionally engaging a portion of the bin to prevent over-travel of the second upright post downwardly within the second slot.

9. The refuse container of claim 8 further comprising:

a fixed second handle integrally formed with the bin having the pivot point thereon wherein the first and second upright posts fit within third and fourth upright posts of the fixed handle.

10. The refuse container of claim 2 further comprising:

a pair of fixed bottom handles located on opposing sides of the bin and integrally formed therewith, each fixed bottom handle including a recess formed in the bin and extending inwardly into the cavity and a cross member spanning the recess, the pair of fixed bottom handles substantially horizontally aligned with the wheels.

11. The refuse container of claim 10 wherein the locking mechanism comprises:

a spring-loaded locking mechanism for maintaining the lid in the closed position located opposite the handle, the spring-loaded locking mechanism comprising:

a rotating latch pivotally joined to the lid and extending downwardly therefrom over a portion of the front wall and having a catch; and a moveable button assembly having a keeper extending outwardly relative to the front wall and selectively engaging the catch to maintain the spring-loaded locking mechanism in a locked position wherein the rotating latch is maintained in a locked position and the lid is retained in the closed position, the moveable button being selectively movable against a spring-force to disengage the keeper from the catch wherein the rotating latch is in an unlocked position and the lid may be selectively pivoted to the open position.

12. A refuse container comprising:

a container assembly comprising:

a bin having opposing front and rear walls joined by opposing sidewalls defining a cavity;

a lid rotatably coupled to the bin at a pivot point and movable relative to the bin between an open position providing access to the cavity and a closed position inhibiting access to the cavity;

a bottom opposite the lid wherein the cavity lies therebetween, the bottom having a first bottom handle integrally molded with the bin located on one of the sidewalls;

a pair of wheels located at the bottom of the refuse container adjacent the rear wall of the bin and having a wheel axis of rotation transverse to the opposing sidewalls wherein the bottom handle is located forward of the pair of wheels between the pair of wheels and the front wall; and a spring-loaded locking mechanism for maintaining the lid in the closed position located opposite the handle, the spring-loaded locking mechanism comprising:

a rotating latch pivotally joined to the lid and extending downwardly therefrom over a portion of the front wall and having a catch; and a moveable button assembly having a keeper extending outwardly relative to the front wall and selectively engaging the catch to maintain the spring-loaded locking mechanism in a locked position wherein the rotating latch is maintained in a locked position and the lid is retained in the closed position, the moveable button being selectively movable against a spring-force to disengage the keeper from the catch wherein the rotating latch is in an unlocked position and the lid may be selectively pivoted to the open position.

13. The refuse container of claim 12 wherein the first bottom handle is substantially horizontally aligned with the pair of wheels.

14. The refuse container of claim 13 further comprising a second bottom handle located on an opposing sidewall to the first bottom handle and generally vertically and horizontally aligned therewith.

15. The refuse container of claim 14 wherein each bottom handle comprises a recess formed in the bin and extending inwardly into the cavity and having a substantially horizontal cross member spanning the recess to form a grabbing location to accommodate a user's hand around the cross member and into the recess.

16. The refuse container of claim 15 wherein each bottom handle is in a fixed location.

17. The refuse container of claim 16 further comprising:

an extensible handle assembly located adjacent the pivot point, vertically disposed above the wheel axis of rotation, and movable from a lower retracted position to an upper extended position above an upper surface of the lid.

* * * * *

UNITED STATES PATENT AND TRADEMARK OFFICE

CERTIFICATE OF CORRECTION

PATENT NO. : 9,248,964 B2
APPLICATION NO. : 14/536965
DATED : February 2, 2016
INVENTOR(S) : Joachim Banik It is certified that error appears in the above-identified patent and that said Letters Patent is hereby corrected as shown below:

On the title page, in Column 1, Item (71) Applicant, delete "Ococomowoc," and insert --Oconomowoc,-- therefor;

In the claims:

In Column 8, Line 66, in Claim 1, delete "refracted" and insert --retracted-- therefor.

Signed and Sealed this
Twelfth Day of April, 2016

Michelle K. Lee

Michelle K. Lee
*Director of the United States Patent and Trademark Office*